United States Patent [19]

Sato et al.

[11] Patent Number: 4,911,223

[45] Date of Patent: Mar. 27, 1990

[54] ENDLESS TRACK TYPE CONTINUOUS CASTING MACHINE

[75] Inventors: Hisashi Sato; Shuzo Takahashi; Shiro Osada; Yutaka Tsuchida; Nobuhisa Hasebe, all of Yokohama, Japan

[73] Assignees: Ishikawajima-Harima Jukogyo Kabushiki Kaisha; Nippon Kokan Kabushiki Kaisha, both of Tokyo, Japan

[21] Appl. No.: 262,476

[22] Filed: Oct. 25, 1988

[30] Foreign Application Priority Data

Nov. 17, 1987 [JP] Japan ..... 62-289821

[51] Int. Cl.[4] ..... B22D 11/04; B22D 11/06

[52] U.S. Cl. ..... 164/430; 164/481

[58] Field of Search ..... 164/430, 431, 432, 436, 164/481, 491

[56] References Cited

U.S. PATENT DOCUMENTS 4,682,646 7/1987 Hulek ..... 164/431

FOREIGN PATENT DOCUMENTS 0268143 5/1988 European Pat. Off. ..... 164/491
3042260 6/1982 Fed. Rep. of Germany ..... 164/436
55-103261 8/1980 Japan ..... 164/436

*Primary Examiner*—Richard K. Seidel
*Assistant Examiner*—Rex E. Pelto

[57] ABSTRACT

A side dam block disposed along the widthwise end portion of a block mold is supported by springs such that the side dam block is pressed against the casting flat surface of the opposing block mold so that gap between the opposing block molds can be suitably adjusted.

1 Claim, 4 Drawing Sheets

ENDLESS TRACK TYPE CONTINUOUS CASTING MACHINE

BACKGROUND OF THE INVENTION

The present invention relates to an endless track type continuous casting machine capable of adjusting a gap between paired block molds.

Referring to FIG. 1, a conventional endless track type continuous casting machine will be described. A plurality of block molds 1 are interconnected in the form of an endless track to define a mold assembly 2. A pair of upper and lower mold assemblies 2 are disposed in opposing relationship to define a mold cavity 3. A tundish nozzle 5 extends from a bottom of a tundish 4 into one opening of the casting mold cavity 3.

As shown in FIG. 2, each block mold 1 is in the form of an L when viewed from the front and is supported by a carrier 6 which in turn has wheels 7 at either end thereof. The wheels 7 are supported on groove-shaped rail portions 9 of frames 8. One carrier 6 is provided for one block mold 1.

Referring back to FIG. 1, reference numeral 10 represents a driving roll; 11, an idle roll; and 12, a casting.

With the conventional endless-track type continuous casting machine described above, melt is poured into the tundish 4 and is supplied through the tundish nozzle 5 into the mold cavity 3 defined by the upper and lower mold assemblies 2 which are driven by the driving and idle rolls 10 and 11 so that the supplied melt is cooled by the block molds 1 to solidify into a casting 12 which is discharged molds 1 to solidify into a casting 12 which is discharged out of the continuous casting machine. Leakage of the melt in the widthwise direction of the mold cavity 3 is prevented by side dam blocks 1*a* integrally attached to the widthwise ends of the block molds 1.

The conventional endless track type continuous casting machine has various problems. Firstly, the casting 12 with an arbitrarily selected thickness cannot be produced since gap or height of the mold cavity 3 is limited by the thickness of the side dam block 1*a* of the block molds 1. Furthermore, bulging of the casting 12 may occur through thermal recuperation due to unsatisfactory cooling of the casting 12 since any gap between the tundish nozzle 5 and block molds 1 at a melt-pouring zone cannot be adjusted and a gap may be produced between the casting 12 and block molds 1 when shrinkage occurs due to temperature drop of the casting 12 at the downstream side of the mold cavity 3. Moreover, variations in thickness of the block molds 1 and side dam blocks 1*a* due to thermal expansions cannot be absorbed since the side dam blocks 1*a* are securely and integrally joined to the block molds 1. In addition, the block molds 1 tend to be inclined and cannot be moved in alignment relationship with each other since a gap on the order of about 1.5 mm is needed between the wheel 7 and the non-contact portion of the rail portion 9 for allowing the fabrication tolerance of the side dam blocks 1*a*.

In view of the above, a primary object of the present invention is to adjust the gap between the block molds to substantially solve the above and other problems encountered in the conventional endless track type continuous casting machines.

The above and other objects, effects, features and advantages of the present invention will become more apparent from the following description of some preferred embodiments thereof taken in conjunction with the accompanying drawings.

DETAILED DESCRIPTION OF THE PREFERRED EMBODIMENTS

Figure 3:
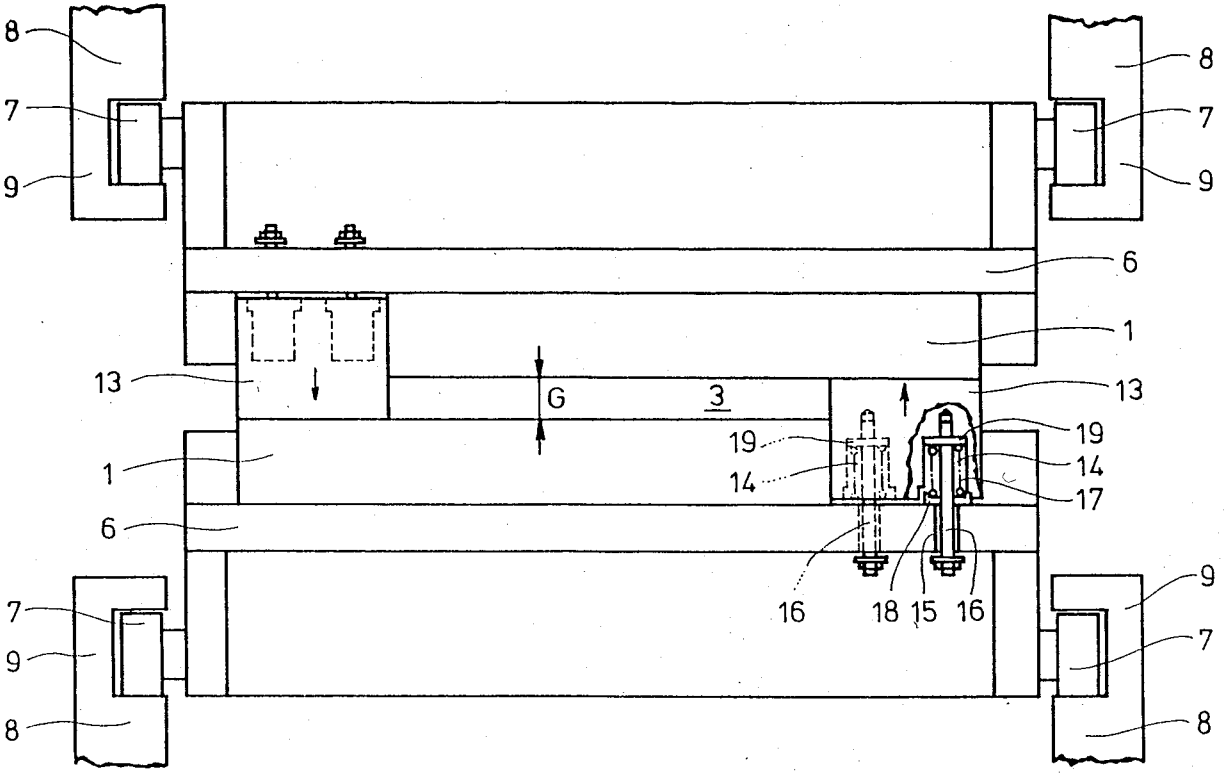
FIG. 3 is a view used to explain a first embodiment of an endless track type continuous casting machine in accordance with the present invention.

Referring now to FIG. 3 illustrating a first embodiment of the present invention, a side dam block 13 is attached to one widthwise side surface of the block mold 1 such that the side dam block 13 is vertically movable. When the upper block mold 1 has a side dam block 13 at its left side, the lower block mold 1 has a side dam block 13 at its right side, the lower surface of the upper side dam block 13 being made contact with the casting surface of the lower block mold 1 while the upper surface of the lower side dam block 13 is made contact with the casting surface of the upper block mold 1.

The upper and lower side dam blocks 13 are formed with vertical recesses 14 into which rods 16 slidably extend through holes 15 of the carriers 6, the rods 16 being securely joined to the side dam blocks 13. A coiled spring 17 is loaded into each recess 14 such that it surrounds the rod 16. One end of the coiled spring 17 is supported by the carrier 16 through a seat 18 through which in turn the rod slidably extends while the other end of the coiled spring 17 is supported by a flange 19 securely joined to the rod 16.

Figure 1:
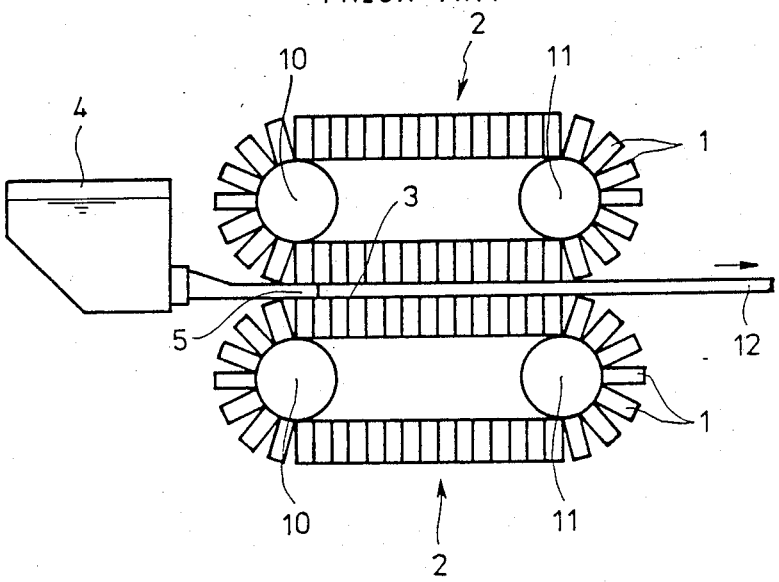
Fig. 1 PRIOR ART
FIG. 1 is a view used to explain a conventional endless track type continuous casting machine.
Figure 2:
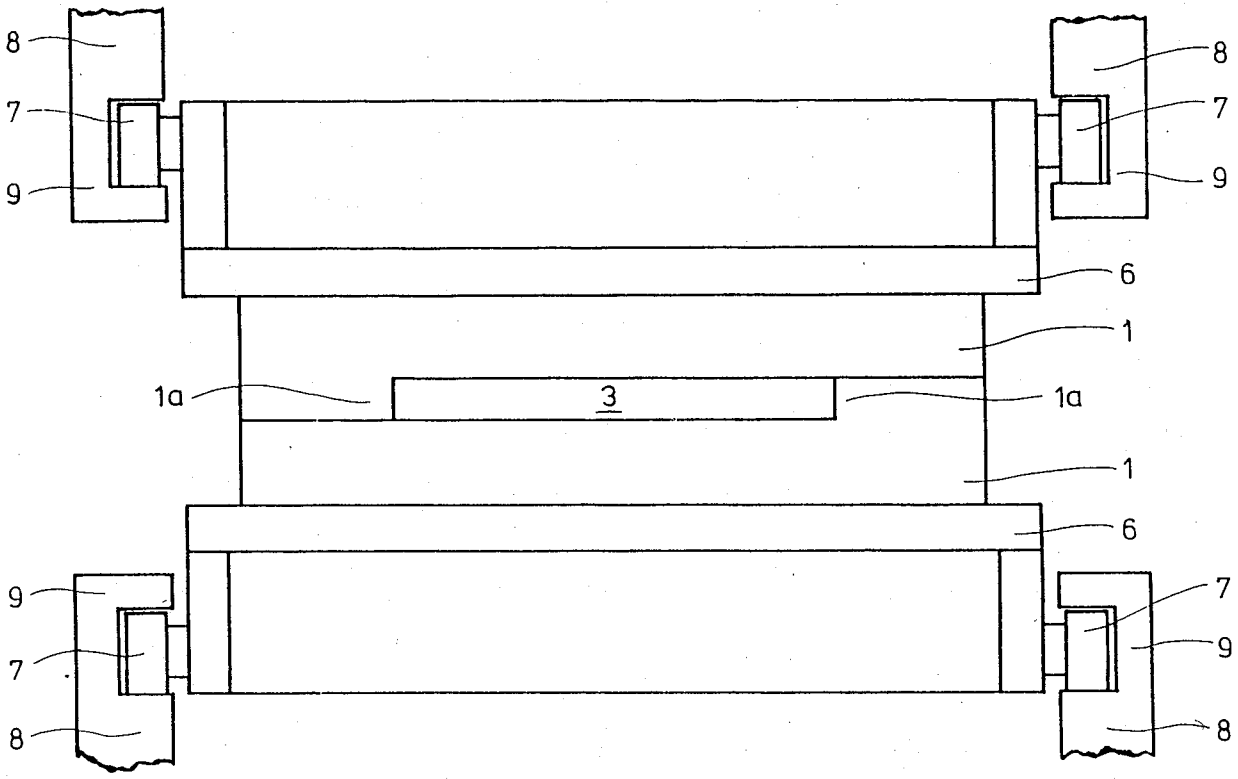
FIG. 2 is a view used to explain block molds and their associated parts used in the continuous casting machine shown in FIG. 1.

In FIGS. 1, 2 and 3, the same reference numerals are used to designate similar parts.

In the casting operation, the lower surface of the upper side dam block 13 is in contact with the casting surface of the lower block mold 1 under the force of the coiled springs 17 while the upper surface of the lower side dam block 13 is forced into contact with the casting surface of the upper block mold 1 under the forces of the coiled springs 17. Melt is supplied from the tundish nozzle 5 (see FIG. 1) into the mold cavity 3 defined by the upper and lower block molds 1 and right and left side dam blocks 13 and is cooled for solidification by the block molds 1 which are driven in a manner substantially similar to that of the conventional endless track type continuous casting machine and a casting thus formed is discharged out of the continuous casting machine. The positions in the direction of height of the side dam block 13 can be adjusted by the coiled springs 17 so that the gap G of the mold cavity 3 is not limited by the thickness of the side dam blocks 13 and consequently a casting with any desired thickness can be produced. Furthermore, the gap between the tundish nozzle 5 and the block molds 1 can be suitably adjusted; the gap G of the mold cavity 3 can be tapered from the upstream side to the downstream side of the mold cavity 3 is response to the shrinkage of a casting being formed; the thermal expansions in the direction of thickness of the block molds 1 and the side dam blocks 13 can be prevented;

and fabrication errors in size and shape in the direction of thickness of the block molds 1 and side dam blocks 13 can be satisfactorily absorbed. As a reslt, the gap between the wheel 7 and the guide portion 9 can be defined on the order of from 0.05 to 1.0 mm so that the block molds 1 can be prevented from being inclined and can be moved in alignment relationship with each other.

Figure 4:
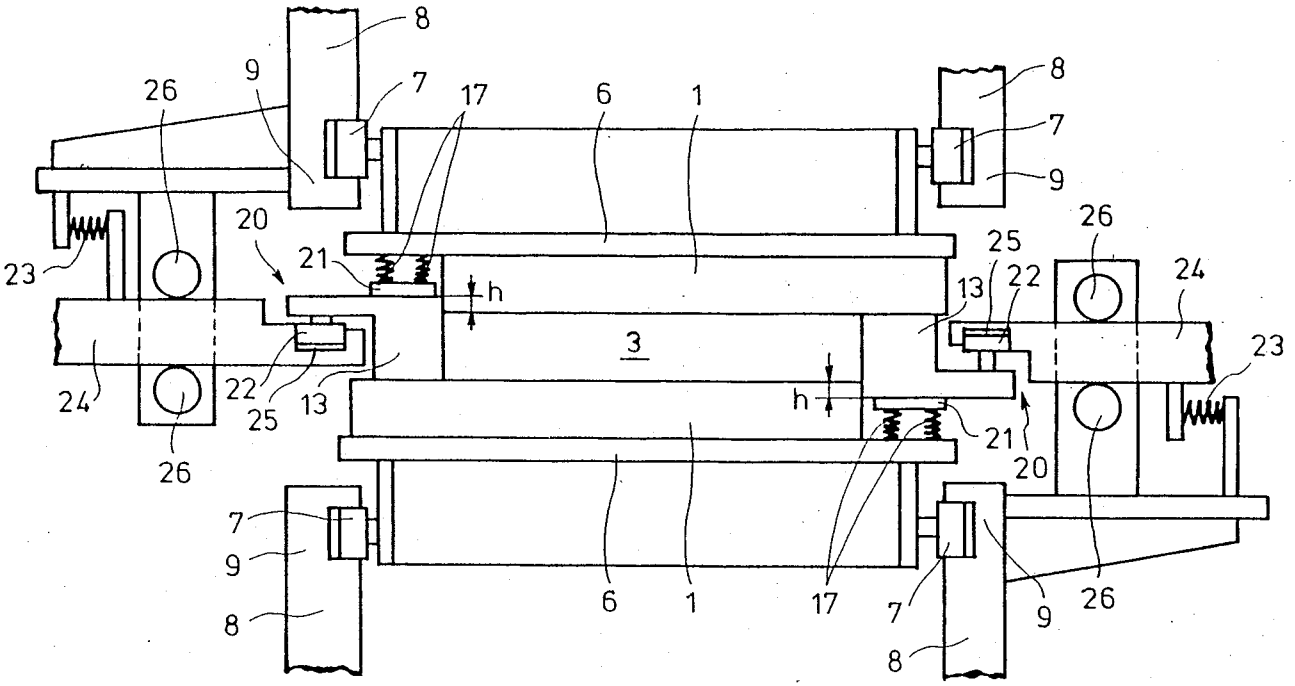
FIG. 4 is a view to explain a second embodiment of the present invention.

FIG. 4 shows a second embodiment of the present invention. In the first embodiment described above with reference to FIG. 3, the side dam blocks 13 and block molds 1 are integrally joined to the carriers 6; but according to the second embodiment, the side dam block 13 is separated from the block mold 1. A plurality of such side dam blocks 13 are interconnected in the direction of movement of the casting to form a side dam assembly 20 which is adapted to rotate or revolve on a horizontal plane. Each side dam block 13 is adapted to abut on the block mold 1 under the forces of the coiled springs 17 through a seat 21. A vertical roller 22 pivoted to each side dam block 13 is rotatably inserted into a guide groove 25 extending, in the direction of the movement of the casting, on a frame 24 which in turn is biased in the widthwise direction of the casting under the force of a coiled spring 23. Furthermore, the frame 24 is guided by a pair of horizontal guide rollers 26 such that it may move in the widthwise direction of the casting under the force of a coiled spring 23.

In operation, one end of the side dam block 13 opposite to its end in contact with the coiled springs 17 is forced into contact with the casting surface of the block mold and the inner side of the side damp block 13 is made into contact with the side surface of the block mold 1 through the vertical roller 22 under the force of the coiled spring 23. Under these conditions, the continuous casting is carried out. Therefore, the second embodiment can attain the same effects as those of the first embodiment described above and furthermore, even the height of the portion of the side dam block 13 in contact with the one side surface of the block mold 1 is low, leakage of melt through such contact surfaces can be prevented and the range of adjustable thickness of castings can be increased.

The endless track type continuous casting machine in accordance with the present invention can attain the following excellent effects:

(I) The side dam block which is movable in the direction perpendicular to the casting surface of the block mold is pressed against the casting surface of the block mold in opposed relationship under the force of spring means so that the gap between the opposing block molds can be suitably adjusted. As a result, (i) it becomes possible to cast a casting with a desired thickness;

(ii) the gap between the tundish nozzle and the block molds can be suitably adjusted so that leakage of melt can be prevented;

(iii) the molding caving can be tapered from the upstream side to the downstream side depending upon the degree of shrinkage of the casting being formed so that the casting can be satisfactorily cooled and consequently the problem of bulging of the casting through thermal recuperation can by prevented;

(iv) thermal expansions of the side dam blocks and block molds can be absorbed; and (v) the gap between the wheel and the guide portion can be decreased so that the inclination of the block molds can be prevented and consequently leakage of melt can be avoided.

(II) The side dam block can be pressed under the force of spring means not only against the frame but also toward the center in the widthwise direction of the block mold through the vertical roller so that even the height of the contact between the side dam block and one side of the block mold is low, leakage of melt through the contact portion can be prevented and consequently the gap between the opposing block molds can be adjusted in a wider range.

What is claimed is:

1. In an endless track type continuous casting machine wherein a pair of upper and lower endless-track-like mold assemblies each comprising a plurality of block molds interconnected are disposed such that opposing surfaces of the mold assemblies are moved in a same direction to define a mold cavity, an improvement comprising a side dam block disposed along a widthwise side portion of a block mold, spring means for movably supporting said side dam block so that said side dam block is movable in a direction perpendicular to a casting surface of the block mold, said spring means pressing said side dam block against a casting surface of an opposing block mold, a frame biased toward a center of the mold cavity in a direction parallel to a casting surface of the block mold by further spring means, said frame being disposed in a direction parallel to a casting surface of the block mold along an outside portion of said side dam block, and a vertical roller pivoted to said side dam block and being rotatably inserted into a guide groove formed and extending on said frame.

* * * * *